US011324380B2

(12) United States Patent
Digman et al.

(10) Patent No.: US 11,324,380 B2
(45) Date of Patent: May 10, 2022

(54) DRAWER TYPE SINGLE CAVITY DISHWASHING APPLIANCE WITH CONVERTIBLE DRIP SHIELDS

(71) Applicant: Midea Group Co., Ltd., Foshan (CN)

(72) Inventors: Robert M. Digman, Goshen, KY (US); Eric Scalf, Louisville, KY (US); Bassam Fawaz, Louisville, KY (US); Joel Boyer, Louisville, KY (US); Russell Dietrich, Taylorsville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 126 days.

(21) Appl. No.: 17/039,129

(22) Filed: Sep. 30, 2020

(65) Prior Publication Data

US 2022/0095881 A1 Mar. 31, 2022

(51) Int. Cl.
*A47L 15/42* (2006.01)
*A47L 15/00* (2006.01)

(52) U.S. Cl.
CPC ..... *A47L 15/4212* (2013.01); *A47L 15/0084* (2013.01)

(58) Field of Classification Search
None
See application file for complete search history.

(56) References Cited

U.S. PATENT DOCUMENTS 3,072,452 A 1/1963 Sleeper
3,288,154 A 11/1966 Jacobs
5,470,142 A 11/1995 Sargeant et al.
5,755,244 A 5/1998 Sargeant et al.
6,055,996 A 5/2000 Sprenger et al.
6,189,551 B1 2/2001 Sargeant et al.
6,260,565 B1 7/2001 Welch et al.
6,289,908 B1 9/2001 Kelsey
7,607,444 B2 10/2009 Gunnerson et al.
7,617,834 B2 11/2009 Bauch
7,678,202 B2 3/2010 Welch et al.
7,775,223 B2 8/2010 Gunnerson et al.
7,850,784 B2 12/2010 Gunnerson et al.
8,038,805 B2 10/2011 Anderson et al.
8,043,437 B1 10/2011 Delgado et al.
8,245,414 B2 8/2012 Watson et al.
8,834,642 B2 9/2014 Delgado et al.
2010/0043249 A1* 2/2010 Mulaw ..... A47L 19/04 34/239
2012/0138107 A1 6/2012 Fountain et al.
2013/0228202 A1 9/2013 Welch et al.
2018/0055333 A1 3/2018 Blanchard et al.

FOREIGN PATENT DOCUMENTS

GB 2356131 A 5/2001

OTHER PUBLICATIONS

Equipline, 500-3D Halo Heat Triple Warming Drawers, www.equipline.co.uk/products/alto-shaam/500-3d-halo-heat-triple-warming-drawers/, Retrieved on May 29, 2018.

* cited by examiner

*Primary Examiner* — Rita P Adhlakha
(74) *Attorney, Agent, or Firm* — Middleton Reutlinger

(57) ABSTRACT

A single cavity dishwashing appliance with one or more drawers is disclosed. The drawer may be moveable between a closed position and an open position. A drip shield may be provided to prevent washing fluid from dripping onto the floor or onto the inner components of the dishwashing appliance when the drawer is in the open position.

26 Claims, 6 Drawing Sheets

DRAWER TYPE SINGLE CAVITY DISHWASHING APPLIANCE WITH CONVERTIBLE DRIP SHIELDS

BACKGROUND

Dishwashing appliances are used in many applications to clean dishes, silverware, cutlery, cups, glasses, pots, and pans, etc. A conventional dishwashing appliance usually has a single cavity and a bottom-hinged door. However, the bottom-hinged door design may bring issues in certain situations. For example, a standard bottom-hinged door of a single cavity dishwashing appliance may block a walkway, extend into a kitchen island, or be too cumbersome to open in a tiny kitchen space.

Therefore, there remains a need in the art to improve the existing dishwashing appliances.

SUMMARY

The present disclosure is directed to an apparatus of a single cavity dishwashing appliance with one or more drawers. Each drawer may have a sealing face and be able to be extracted individually from the single cavity. The bottom of the drawer may be open to improve the washing performance. As this open drawer bottom design may pose an obstacle of drips of washing fluid potentially falling onto the floor and/or the dishwashing appliance, one or more convertible drip shields may be provided to collect the dripping washing fluid in a first position when the drawer is pulled out from the single cavity. When the drawer is pushed back into the single cavity, the convertible drip shield may shift to a second position, and the drawer bottom may stay open during the dishwashing operation.

In some embodiments, a dishwashing appliance may comprise a cabinet defining a singular cavity therein, a spray system having one or more spray arms within the cavity, one or more drawers mounted within the cavity, and one or more drip shields below the open bottom of the one or more drawers. The one or more drawers may have an open bottom and be moveable between a closed position and an open position. The one or more drip shield may be moveable between a first position and a second position.

In some embodiments, a kitchen appliance may comprise a cabinet defining a singular cavity therein, one or more drawers moveable mounted within the cavity, and one or more drip shields below the open bottom of the one or more drawers. The one or more drawers may have an open bottom and be moveable between a closed position and an open position. The one or more drip shield may be moveable between a first position and a second position.

In some embodiments, a dishwashing appliance may comprise a cabinet defining a singular cavity therein, a spray system having one or more spray arms within the cavity, and one or more drawers mounted within the cavity. The one or more drawers may have an open bottom to allow washing fluid from the spray system to spray therethrough and be moveable between a closed position and an open position.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein.

Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure

DETAILED DESCRIPTION

Figure 1:
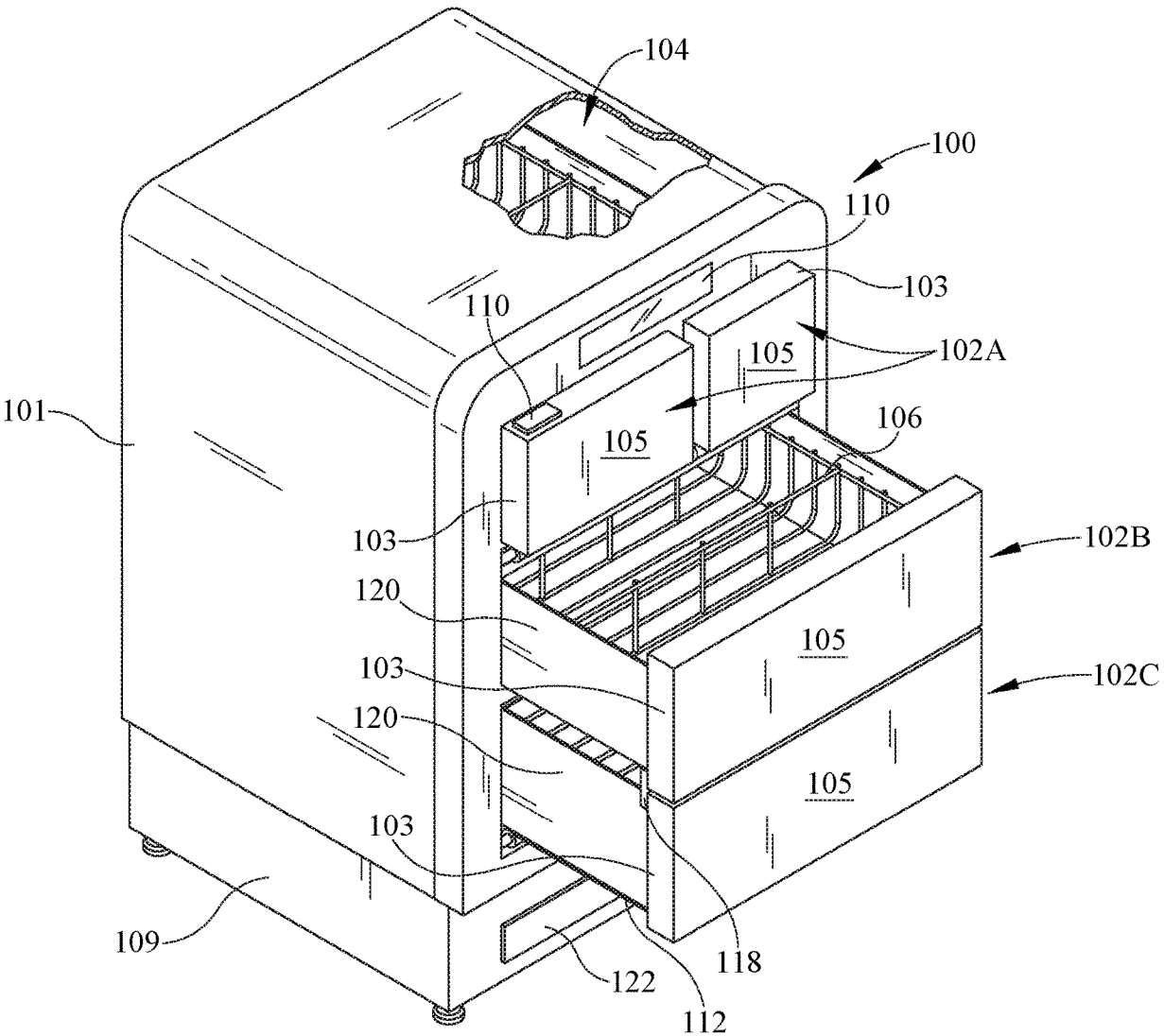
FIG. 1 is a perspective view of a drawer type single cavity dishwashing appliance, according to an embodiment of the present disclosure.

It is to be understood that a drawer type single cavity dishwashing appliance is not limited in its application to the details of construction and the arrangement of components set forth in the following description or illustrated in the drawings. The described embodiments are capable of other configurations and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalents thereof, as well as additional items. Unless limited otherwise, the terms "connected," "coupled," and "mounted," and variations thereof herein, are used broadly and encompass direct and indirect connections, couplings, and mountings. In addition, the terms "connected" and "coupled" and variations thereof are not restricted to direct physical or mechanical connections or couplings.

The embodiments discussed hereinafter will, for convenience only, focus on the implementation of the hereinafter-described techniques within a residential type dishwashing appliance. However, it will be appreciated that the herein-described techniques may also be used in connection with other types of kitchen appliances in some embodiments. For example, the herein-described techniques may be used in a commercial dishwashing application or a cooking appliance (e.g., an oven) in some embodiments. Moreover, at least some of the herein-described techniques (e.g., a convertible drip shield) may be used in connection with other different dishwashing appliance configurations, including dishwashing appliances utilizing hinged doors.

Turning now to the drawings, wherein like numbers denote like parts throughout the several views, FIG. 1 is a prospective view of a drawer type single cavity dishwashing appliance 100 according to an embodiment of the present disclosure. The dishwashing appliance 100 may share many features of a conventional dishwashing appliance and may not be described in detail herein except as necessary for a complete understanding of the disclosure. As shown in FIG. 1, the dishwashing appliance 100 may include one or more drawers 102 that may be mounted in a cabinet or housing 101, which may define a washing cavity 104 therein. The cavity 104 may be a stamped metal cavity or an injection molded plastic cavity, with a top wall, a bottom wall, a rear wall, and opposing side walls. The top wall, bottom wall, rear wall and opposing side walls may be planar elements surrounding the cavity 104. The cavity 104 may have an open front face that may be accessible by opening the one or more drawers 102. In some embodiments, the drawer 102 may include a drawer front 103 (e.g., a drawer door) at its front and include an interior drawer space defined by a front drawer wall, opposing side drawer walls, a rear drawer wall, wherein the front drawer wall is defined by a rear plate of the drawer front 103. The drawer front 103 may further include a top edge, a bottom edge, opposing side edges, a front surface 105 on the front side of the drawer front 103, and a sealing surface 113 on the back side of the drawer front 103 for contacting the cabinet 101.

In some embodiments, one or more dishwashing racks 106 may be provided within the interior drawer space of the drawer 102. It should be understood that the rack 106 may be in any feasible configurations suitable for holding dishes, pans, glasses, cups, utensils, or other washable items that may be treated in the cavity 104 without detracting from the disclosure. For example, in some embodiments as shown here, the rack 106 may include a plurality of tines to help support the washable items. It should be also understood that other particular support apparatus other than the rack 106 may be provided within the drawer 102 for supporting the washable items to be washed during dishwashing operation.

In some embodiments, the drawer 102 may include a side track having a roller mounted thereon so that the drawer 102 may be slid inwardly and outwardly from a closed position to an open position, and vice versa, in a conventional manner. The closed position may be a position when the dishwashing appliance 100 is in operation, and the open position may be a different position to dry, load, and/or unload the washable items. In some embodiments, the closed position may correspond to the one or more drawers 102 respectively being entirely within the cavity 104 and the sealing surface 113 contacting the cabinet 101, and the open position may correspond to a position different from the closed position when at least a portion of the drawer 102 is outside of the cavity 104. The drawer 102 may travel in a substantially horizontal plane into and/or out of the cavity 104 between the open position and the closed position. It should be understood that the substantially linear movement of the drawer 102 may also be in a variety of angles in one or both the directions into and/or out of the cavity 104 between the open position and the closed position. In some embodiments, a door handle (not shown) may be provided on the front surface 105 of the drawer front 103 for grasping by a user to move the drawer 102 in and out of the cavity 104 between the open position and the closed position.

Figure 4:
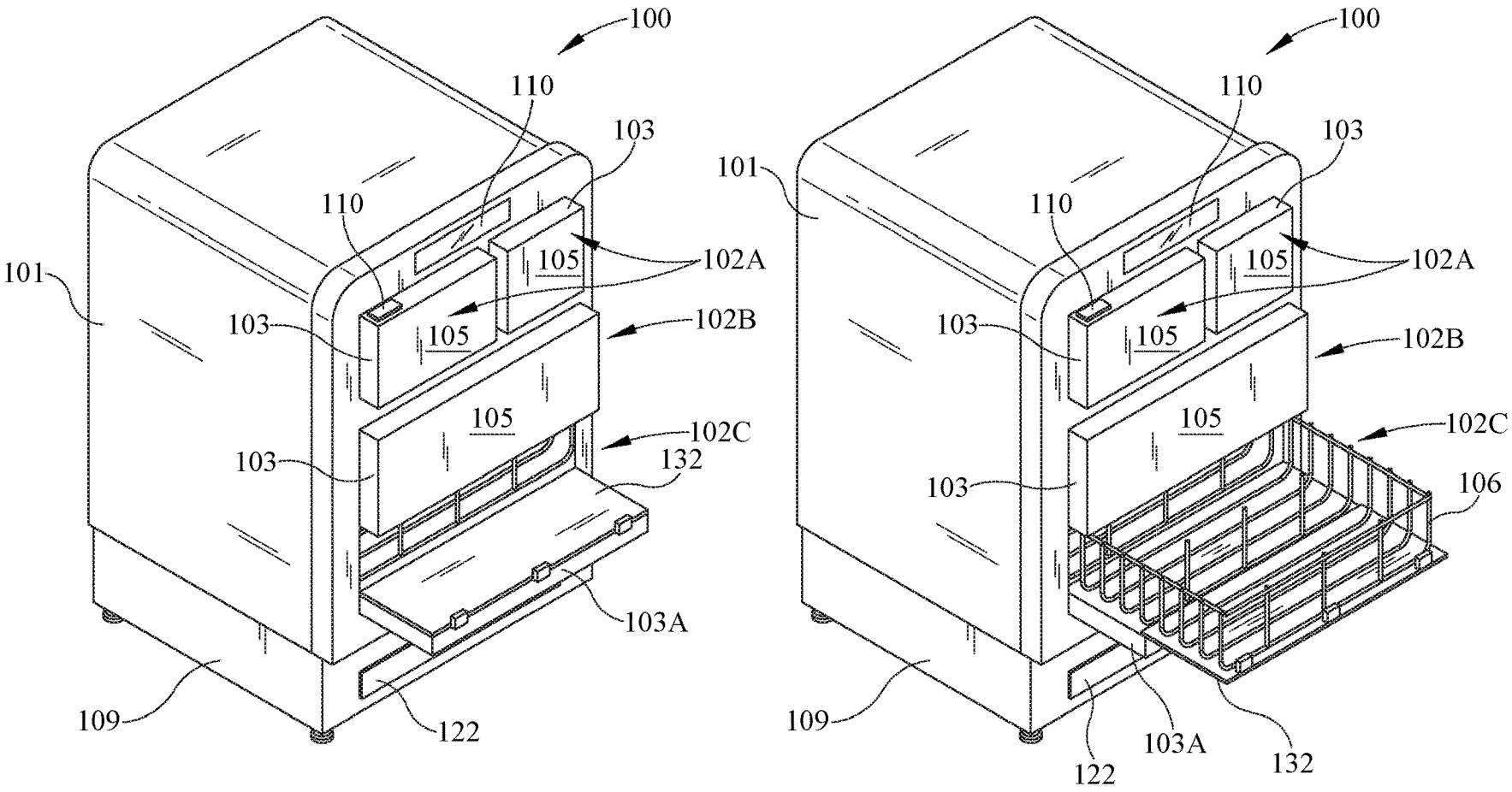
FIG. 4 is a perspective view of a drawer type single cavity dishwashing appliance having a bottom hinged door, with a convertible drip shield built in the bottom hinged door, according to an embodiment of the present disclosure.
Figure 5C:
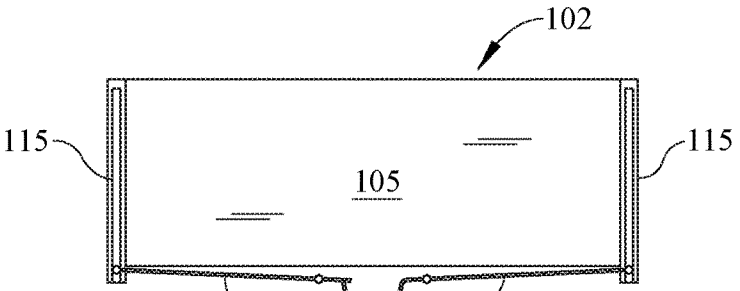
FIGS. 5A-5E are various side views and perspective views of a drawer with a convertible drip shield in a two-piece configuration, according to an embodiment of the present disclosure.
Figure 5D:
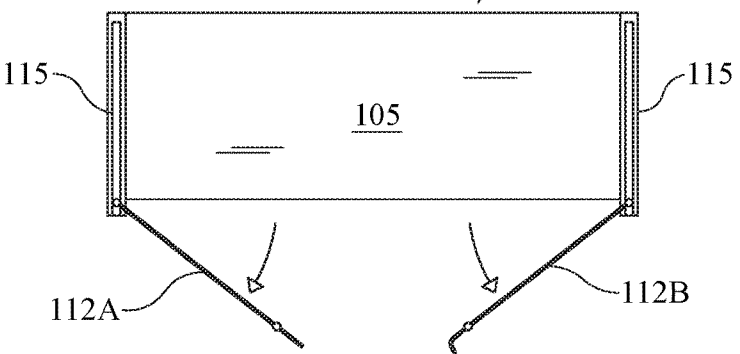
Figure 5E:
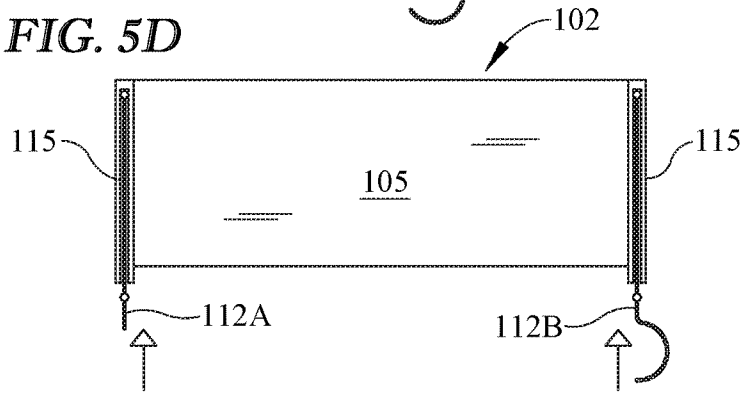
Figure 5A:
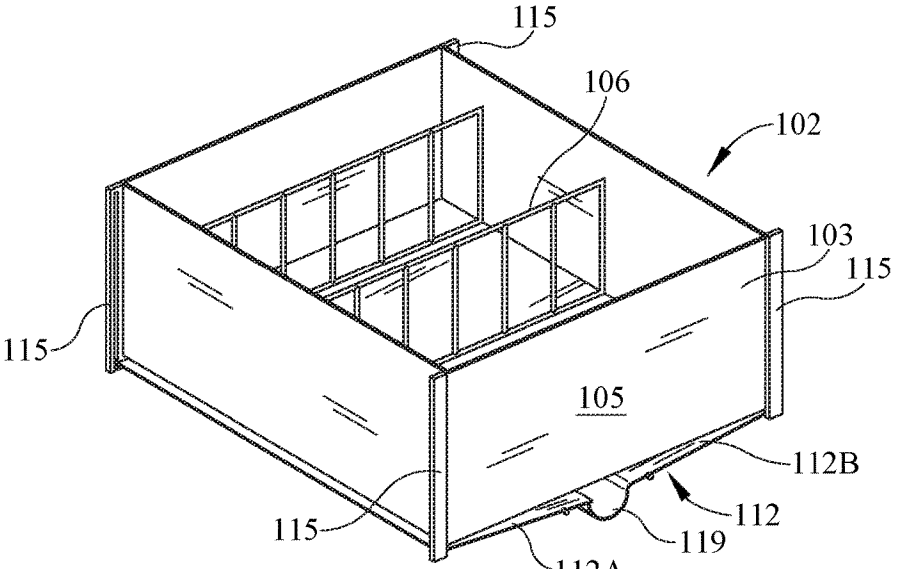
Figure 5B:
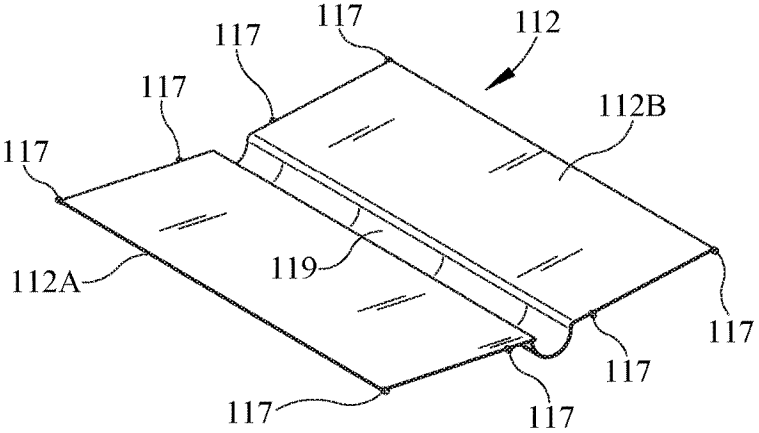

The dishwashing appliance 100 may have various drawer configurations. In some embodiments, the one or more drawers 102 may be arranged in a side-by-side and/or a stacked configuration to increase compartmentalization, with the advantage of being separate drawers for different kinds of washable items such as silverware, glasses, and plates, etc. For example, as shown by the specific dishwashing appliance 100 in FIG. 2, a upper drawer 102A may be configured for small washable items 1 such as glasses and silverwares, etc., and a larger middle drawer 102B at a lower portion may be configured for large washable items 2 such as plates, bowls, pots, and pans, etc. The smaller upper drawer 102A may also be configured for smaller batches/volumes of large washable items 2, thereby potentially increasing the efficiency of the dishwashing appliance 100 by possibly minimizing the amount of water and energy needed to wash fewer items. In some other embodiments, only an upper portion of the dishwashing appliance 100 may include the one or more drawers 102 arranged in the side-by-side and/or the stacked configuration, and a lower portion of the dishwashing appliance 100 may be similar to a conventional dishwashing appliance with a bottom hinged door 102C (as shown in FIG. 4) or a side pivoting door. In some embodiments, a divider or mullion 107 may be provided among the one or more drawers 102 to create a seal across the cavity 104. In different embodiments, the mullion 107 may also be attached to the drawer 102 in different manners.

Figure 2:
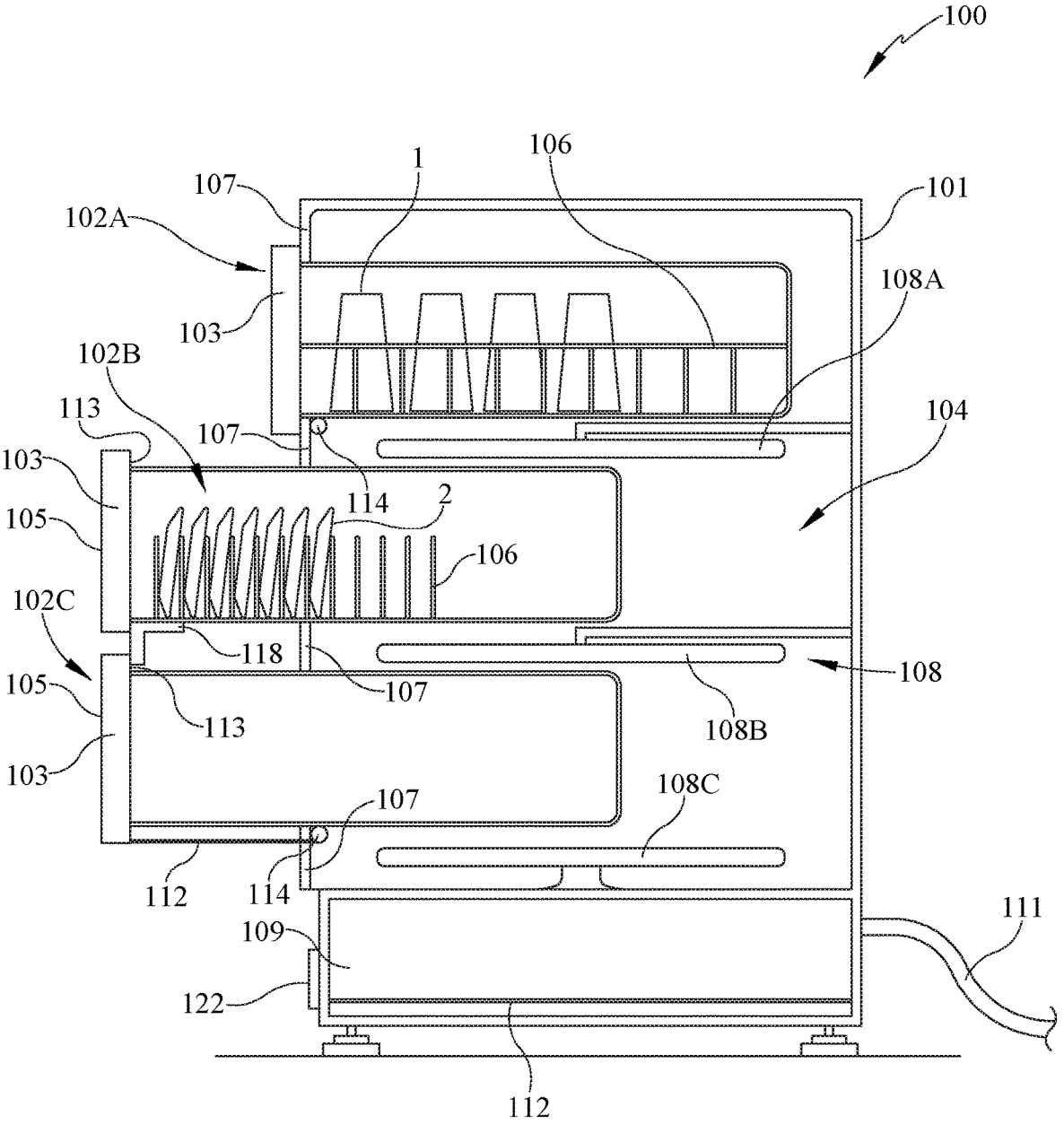
FIG. 2 is a side view of the interior of the dishwashing appliance of FIG. 1, according to an embodiment of the present disclosure.

During the dishwashing operation, washing fluid may be sprayed onto the washable items situated in the drawer 102, and a spray system may be provided for supplying the washing fluid within the cavity 104. The spray system may include one or more washing fluid sprayers, which are illustrated in the form of one or more spray arm assemblies 108 as best shown in FIG. 2. The one or more arm assemblies 108 may be provided within the cavity 104 in a stacked manner and oriented relative to the drawer 102 such that washing fluid sprayed from the spray arm assembly 108 may be directed onto the washable items within the drawer 102. For example, the spray arm assembly 108 may be positioned relatively below the drawer 102 for directing the washing fluid upwardly onto the washable items, and/or relatively above the drawer 102 for directing the washing fluid downward onto the washable items. In some embodiments, as shown in FIG. 2, an upper spray arm assembly 108A below the upper drawer 102A, a middle spray arm assembly 1088 below the middle drawer 102B, and a bottom spray arm assembly 108C below the bottom drawer 102C may respectively provide a washing fluid spray upwardly through the bottom of each of the drawers 102A, 1028, and 102C. It should be understood that the upper spray arm assembly 108A and the middle spray arm assembly 108B may also optionally provide a washing fluid spray downwardly onto washable items there underneath. In some embodiments, while the upper and middle spray arm assemblies 108A and 108B may be fixed spray arms, the bottom spray arm assembly 108C may be a rotational spray arm.

The one or more spray arm assemblies 108 may be supplied by respective conduits, along with a main supply 111 interconnected with a pump driven by a motor (not shown) located in a lower compartment 109. Finally, the dishwashing appliance 100 may be provided with a drain/sump portion (not shown) located in the lower compartment 109 for removing residual washing fluid from the cavity 104. It should be understood that the arrangement and/or the configuration of the one or more spray arm assemblies 108 is not limited to the present disclosure as the description here merely serves for illustration. For example, the dishwashing appliance 100 may alternatively include various combinations of wall-mounted sprayers, rack-mounted sprayers, oscillating sprayers, fixed sprayers, rotating sprayers, and focused sprayers, etc.

In some embodiments, a control panel 110 may be provided to control the dishwashing appliance 100, and the location of the control panel 110 may vary. In some embodiments, the control panel 110, or portions thereof, may be on the outer surface of the dishwashing appliance 100. For example, as shown in FIG. 1, the control panel 110 may be located on the top edge of the drawer front 103, the front surface of the cabinet 101, and/or on the front surface 105 (not shown). In some other embodiments, the control panel 110 may be located interior of the drawer 102 and/or adjacent the drawer 102 within the cavity 104. For example, in some embodiments, portions of the control panel 110 may be accessible when the drawer 102 is in the open position. It should be understood that in different embodiments, the control panel 110 may include various types of input and/or output devices, including various knobs, buttons, lights, switches, textual and/or graphical displays, and touch screens, etc., through which a user may configure one or more settings and start and stop a wash cycle or movement. For example, in some embodiments, the drawer 102 may be configured to close/open and/or lock/unlock by proximity of one or more users and/or by one or more gestures/forces or bodily movement relative to the drawer 102 and/or portions of the dishwashing appliance 100.

In general, it should be understood that some features described above do not constitute limitations of the present disclosure, but rather have only been described for the sake of completeness. Instead, the present disclosure is particularly directed to a drawer-type single cavity dishwashing appliance configuration along with convertible drip shields. As described above, the bottom of the drawer 102 may comprise an open configuration during the dishwashing operation to ensure that the washable items are exposed to jets of washing fluid. While effective at establishing a more efficient distribution of washing fluid, however, the open bottom of the drawer 102 may be prone to leak or drip washing fluid onto the floor or onto the internal components of the dishwashing appliance 100 when the drawer 102 is in the open position. Washing fluid dripping may cause consumers maintenance issues, operation failures, or even safety issues. Thus, one or more drip shields 112 may be needed to prevent washing fluid from dripping onto the floor or onto the internal components of the dishwashing appliance 100 when the drawer 102 is in the open position for unloading/loading washable items. Generally, the drip shield 112 may be positioned below the open bottom of the drawer 102 to collect drips of washing fluid, and may be convertible between a first position and a second position along with the movement of the drawer 102 simultaneously or independently. When the drip shield 112 is in the first position, the drip shield 112 may be configured to allow washing fluid from the spray arm assembly 108 to spray through the open bottom of the drawer 102 when the drawer 102 is in the closed position during the dishwashing operation. When the drip shield 112 is in the second position, the drip shield 112 may be configured to collect drips of washing fluid dripping through the open bottom of the drawer 102 when the drawer 102 is in the open position.

Figure 3B:
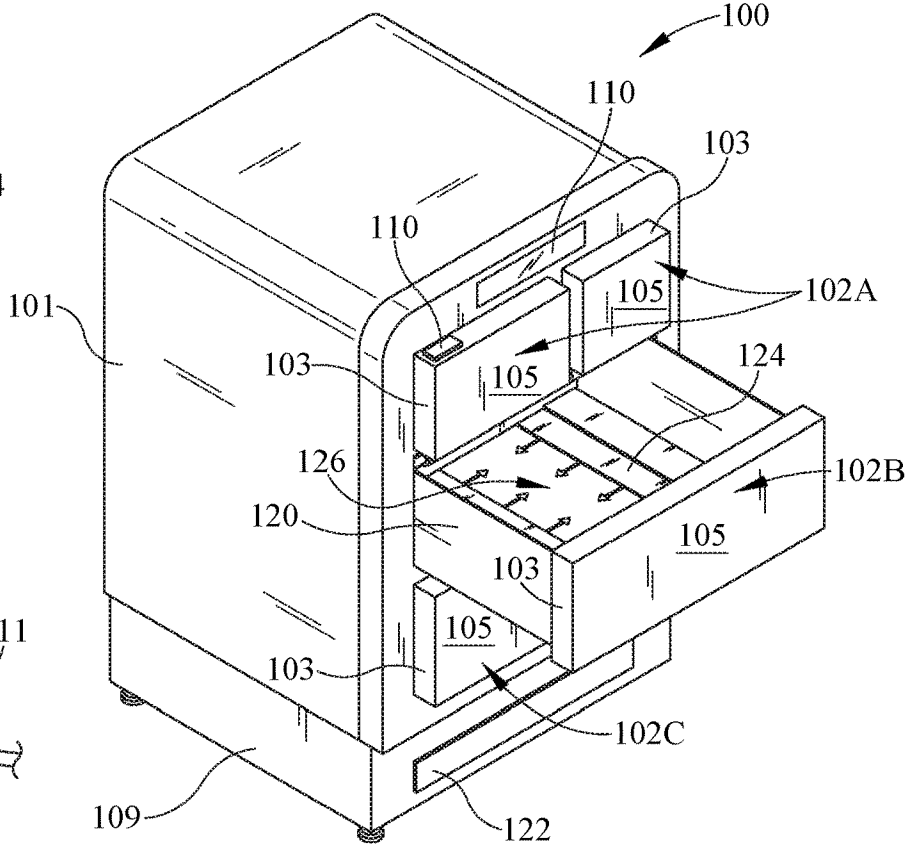
FIG. 3B is a perspective view of a drawer with a convertible drip shield in a moving partition configuration, according to an embodiment of the present disclosure.
Figure 3A:
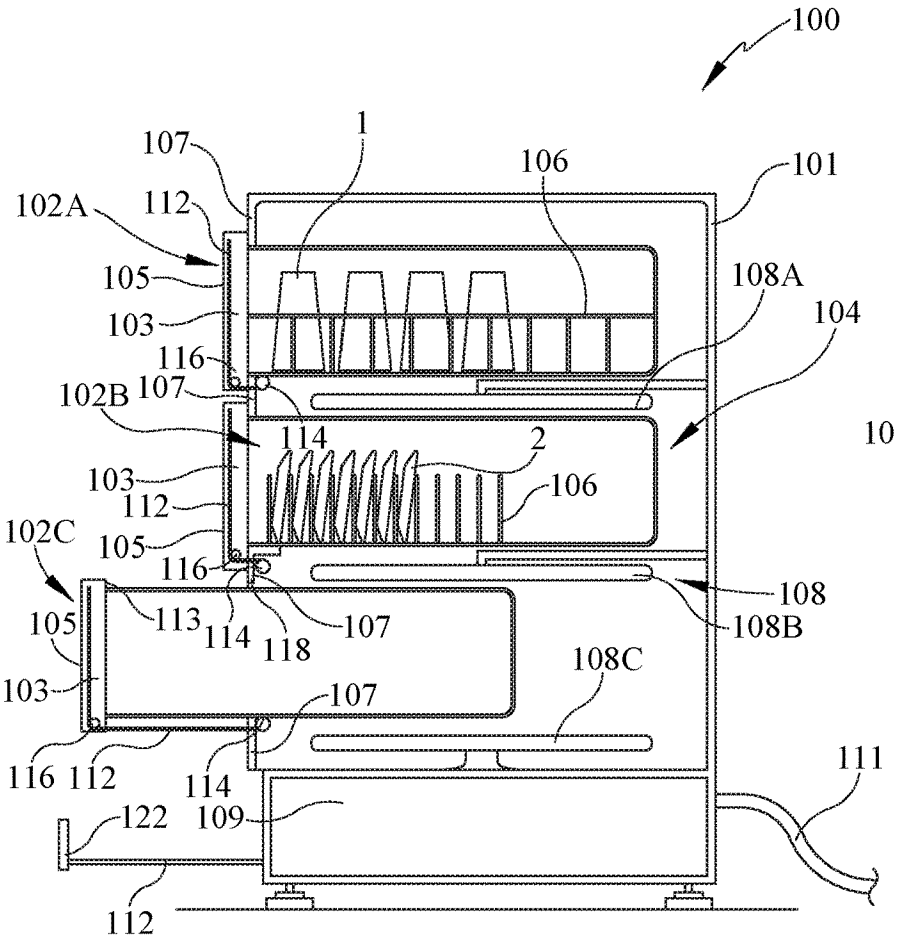
FIG. 3A is a side view side view of the interior of the dishwashing appliance, according to another embodiment of the present disclosure.

In some embodiments, as shown in FIGS. 2 and 3A, the drip shield 112 may be a retractable film rolled in a roller or reel 114. For example, the retractable film drip shield 112 may work like a roller shade design with the drip shield 112 made of a thin plastic or plastic-like film. It should be understood that any suitable material may be used for the drip shield 112. In some embodiments, the material of the drip shield 112 may be water repellent. For example, the drip shield 112 may be a semi water-permeable film working like a fine screen to collect drips of washing fluid from the drawer 102. The roller 114 may be an apparatus with a retraction mechanism suited in a housing for receiving the drip shield 112 that may be rolled up therein. In some embodiments, the roller 114 may include a torsion spring (e.g., a spiral clock spring, a coil spring, etc.) as the retraction mechanism for retracting the rolled-up drip shield 112. The roller 114 and the free end of the drip shield 112 may be secured at different locations in different embodiments. For example, in some embodiments as best shown in FIG. 2, the roller 114 may be secured at the cabinet 101 and/or interior of the cavity 104 (e.g., proximate the mullion 107) for receiving one end of the drip shield 112, and the other free end of the drip shield 112 may be fixed to the drawer 102 (e.g., at the bottom of the drawer front 103) to allow the retractable drip shield 112 to extend from the first position to the second position simultaneously with the drawer 102 sliding from the closed position to the open position, and to retract from the second position to the first position simultaneously with the drawer 102 sliding from the open position to the closed position. With the roller 114 located in the cavity 104, the surface of the rolled-up drip shield 112 in a spaced spiral configuration may be cleaned up by washing fluid sprayed by the spray arm assembly 108 during the dishwashing operation. In some embodiments, a secondary spray system may be provided at one or both ends of the drip shield 112 for cleaning the surface of the drip shield 112.

In some other embodiments as best shown in FIG. 3A, the roller 114 may still be secured at the cabinet 101 and/or interior of the cavity 104 (e.g., proximate the mullion 107) for receiving one end of the drip shield 112, while the other free end of the drip shield 112 may be secured on and/or within the drawer front 103 of the drawer 102 (e.g., at a top interior portion of the drawer front 103), through a slot at the bottom of the drawer front 103, to allow the retractable drip shield 112 to extend from the first position to the second position simultaneously with the drawer 102 sliding from the closed position to the open position, and to retract from the second position to the first position simultaneously with the drawer 102 sliding from the open position to the closed position. In such embodiments, when the drawer 102 is slid out from the closed position to the open position, the drip shield 112 may be drawn down and extend under the open bottom of the drawer 102. It should be understood that the roller 114 should be configured to retain enough volumes of the drip shield 112 to make up the length and/or height difference of the drawer 102. In some embodiments, a pulley 116 may be provided at a bottom portion of the drawer front 103 for improving the retraction process when the free end of the drip shield 112 is secured at the top portion of the drawer front 103. It should be understood that the locations of the roller 114 for receiving one end of the drip shield 112 and the fixed point for securing the other free end of the drip shield 112 are not limited to the description above. For example, the locations of the roller 114 for receiving one end of the drip shield 112 and the other free end of the drip shield 112 may be switched over without detracting from the disclosure. It should be also understood that, in some embodiments, the roller 114 and/or the pulley 116 may not be needed if the flexible material of the drip shield 112 is stiff enough to self-support the tension for retraction/extension, and the two ends of the drip shield 112 may be respectively secured at the cabinet 101 and the drawer 102 directly in such embodiments.

Besides collecting drips of washing fluid from the open bottom of the drawer 102, the retractable drip shield 112 as described above may also facilitate a user to retract the drawer 102 to the closed position with reduced assistance. The retraction force applied on the retractable drip shield 112 by the roller 114 (e.g., the torsion spring force) may transfer to the drawer 102, or portions thereof, by fixing the free end of the retractable drip shield 112 onto the drawer 102, and drive/urge the drawer 102 back towards the closed position. For example, when the drawer 102 is in the closed position, the retraction mechanism (e.g., a torsion spring) within the roller 114 for retracting the retractable drip shield 112 may be in a rest/un-tensioned state, or a less tensioned state compared with the state when the drawer 102 is in the open position. That is, the roller 114 may be biased toward a closed position. When the user progressively forces the drawer 102 from the closed position to the open position in a direction away from the cavity 104, the retraction force stored within the retraction mechanism within the roller 114 may increase as the opening force works against the retraction force. Accordingly, the retraction force obtained through pulling out the drawer 102 from the closed position to the open position may facilitate the return/retraction of the drawer 102 back towards the closed position in the cavity 104. In some embodiments, the drawer 102 may be releasably secured/locked temporarily in the open position (e.g., through a switch, a button, and a handle, etc.) In such embodiments, the drawer 102 may automatically return back towards the closed position in the cavity 104 when the drawer 102 is released by the user for the closed position. For example, the drawer 102 may be pulled out by the user and locked at the open position for loading/unloading washable items. When the loading/unloading is done and upon release, the drawer 102 may automatically retract back into the cavity 104 under the retraction force through the retractable drip shield 112. In some embodiments, the user may manually increase the spring/retraction force by positioning the drawer 102 towards different open positions (e.g., different distances away from the cavity 104).

In some embodiments, the drip shield 112 may be a telescoping shield, with a first end of the telescoping drip shield 112 secured to the cabinet 101 and/or interior of the cavity 104, and a second end of the telescoping drip shield 112 secured to the drawer 102 to allow the telescoping drip shield 112 to extend from the first position to the second position simultaneously with the drawer 102 sliding from the closed position to the open position, and to retract from the second position to the first position simultaneously with the drawer 102 sliding from the open position to the closed position. For example, the telescoping drip shield 112 may be configured with a series of interlocking plates with a telescoping housing.

In some embodiments, one or more linkage mechanisms between the drawers 102 may be provided to allow multiple drawers 102 to move together. For example, in some embodiments as shown in FIGS. 1 and 2, a link 118 may be provided between the middle drawer 102B and the bottom drawer 102C. When the user pulls out the middle drawer 102B from the closed position to the open position, the bottom drawer 102C may be moved along simultaneously through the link 118. In such a manner, the bottom drawer 102C may be able to collect drips of washing fluid from the open bottom of the middle drawer 102B, and another drip shield 112 below the bottom drawer 102C may be used to collect drips of washing fluid therefrom. It should be understood that a plurality of links 118 may be provided among three or more drawers 102 such that sliding the drawer 102 staked above may always move all other drawers staked therebelow together. In such embodiments, only one drip shield 112 located below the bottommost drawer 102 may be needed.

In those embodiments that the drip shield 112 below the bottom drawer 102C is retractable as described above, the location of the roller 114 may be adjusted depending on whether the drain/sump portion of the dishwashing appliance 100 is moved with the bottom drawer 102C or not. For example, if the drain/sump portion of the dishwashing appliance 100 is moved with the bottom drawer 102C, the roller 114 may be located at the bottom back of the middle drawer 102B. If the drain/sump portion of the dishwashing appliance 100 remains in the cavity 104 regardless of the movement of the bottom drawer 102C, the roller 114 may be located at the bottom front of the cavity 104. It should be understood that when the bottom drawer 102C is slid from the closed position to the open position by the user, the middle drawer 102B may remain in its position. It should be also understood that when the link 118 is not provided between the middle drawer 102B and the bottom drawer 102C as shown in FIG. 3A, the middle drawer 102B may have the drip shield 112 therebelow for collecting drips of washing fluid as the bottom drawer 102C.

Figure 3C:
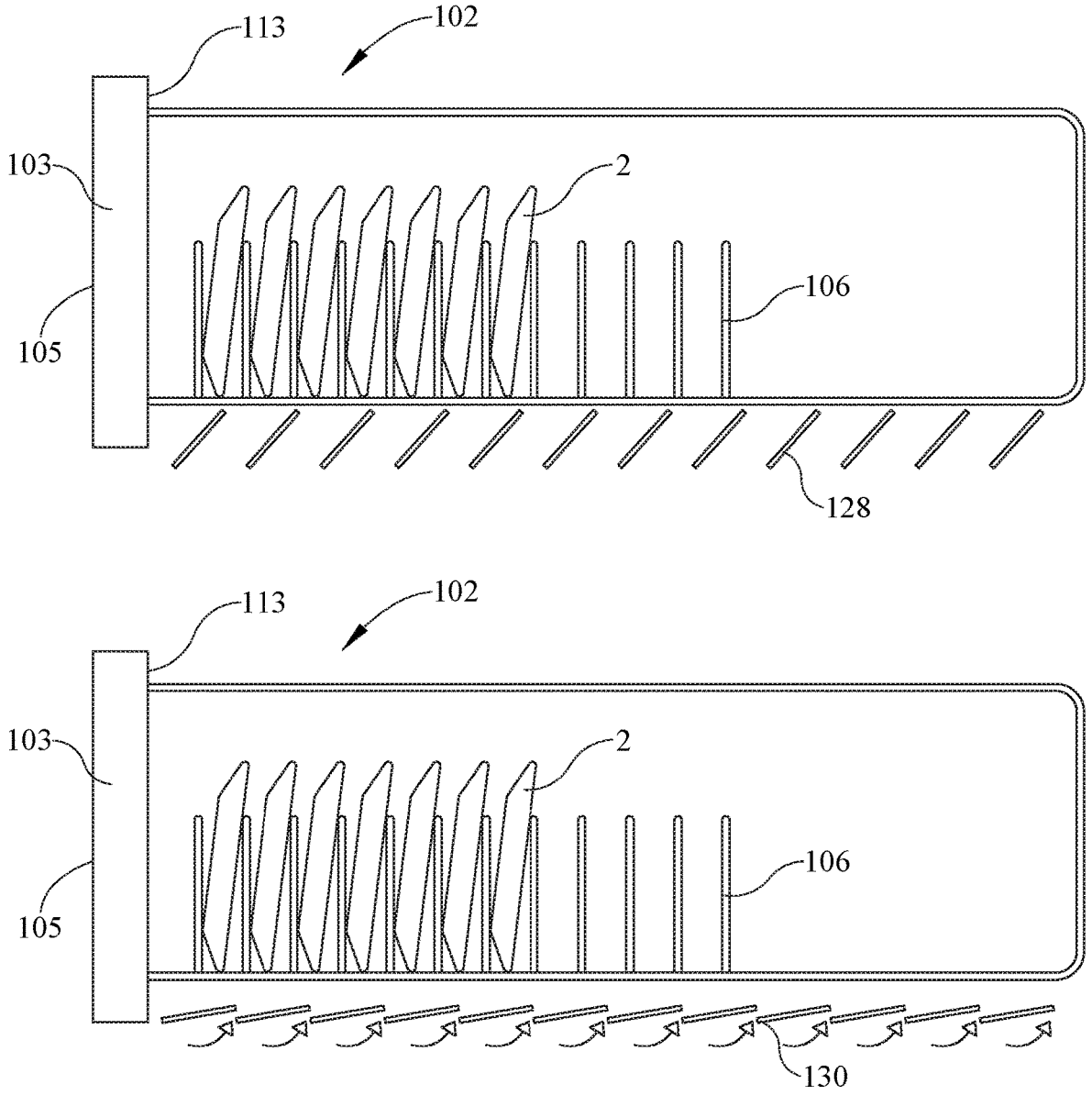
FIG. 3C is a side view of a drawer with a convertible drip shield in a louver configuration, according to an embodiment of the present disclosure.

In some embodiments, as shown in FIG. 3C, the drip shield 112 may be in a louver configuration, and the drip shield 112 may be an open louver 128 in the first position and a closed louver 130 in the second position. In some embodiments, as shown in FIGS. 1, 2, and 4, the drip shield 112 may be combined with a retractable toe panel 122. When the drip shield 112 is in the first position, the retractable toe panel 122 may stow within the bottom of the cabinet 101. When the drip shield 112 is in the second position, the retractable toe panel 122 may extend out to collect drips of washing fluid from the drawer 102. In some embodiments, the drawer front 103 for the drawer 102 may be a hinged drawer front. For example, as shown in FIG. 4, the dishwasher 100 may include a hinged drawer front 103A for the bottom drawer 102C. In such embodiments, the drip shield 112 may stow within the hinged drawer front 103A in the first position and extend out from the hinged drawer front 103A to collect drips of washing fluid from the bottom drawer 102C in the second position (e.g., an integral extendable drip shield plate 132 on the sealing surface 113 of the hinged drawer front 103A). In some embodiments as shown in the FIG. 3B, the drip shield 112 may include one or more moving partitions 124 at the bottom of the drawer 102. For example, when the drawer 102 is in the closed position, the moving partition 124 may be configured to form a gap 126 therebetween to keep the bottom of the drawer 102 open. When the drawer 102 is in the open position, the moving partition 124 may be configured to shift to close the gap 126, following the indicated direction in FIG. 3, to form a sealed piece as the drip shield 112 to collect drips of washing fluid from the drawer 102. In some embodiments, the drip shield 112 may be stowed vertically on the sides of the drawer 102 in the first position and moved to cover the bottom of the drawer 102 horizontally in the second position when the drawer 102 is slid out from the closed position to the open position. For example, as shown in FIGS. 5A-5E, the drip shield 112 may be in a two-piece configuration with a first piece 112A and a second piece 112B. The first piece 112A and the second piece 112B may include one or more tabs 117 for a sliding movement in one or more sliding guides 115 located proximate the drawer 102 (e.g., at the corners). The second piece 1126 may also include a trough 119 for directing the collected drips of washing fluid back into the cavity 104. During operation, an extension mechanism (e.g., a loaded spring) may keep the first piece 112A and the second piece 112B in the horizontal extended position under the open bottom of the drawer 102, and a retraction mechanism (e.g., a projection) may enable the first piece 112A and the second piece 112B shift from the horizontal extended position to the vertical stowed position following the guide 115 when the drawer 102 is closed.

In some embodiments, one or more side shields 120 may be provided at one or more sides of the drawer 102 as shown in the FIG. 1 to work as a splash shield to prevent dripping of washing fluid from the side of the drawer 102. In some embodiments, when the drawer 102 is in the closed position, the splash shield 120 may be retracted within the cavity 104 to allow the side of the drawer 102 to keep open for a more efficient distribution of washing fluid during the dishwashing operation. When the drawer 102 is in the open position, the splash shield 120 may extent out from the cavity 104 to cover the side of the drawer 102 to prevent dripping of washing fluid.

It should be understood that the operation of the convertible drip shield 112 (e.g., the louver configuration, the moving partition configuration, etc.), the splash shield 120, and the toe panel 122 may be activated by a driving mechanism (e.g., a motor) or manually by the user. It should also be understood that the drip shield 112 may be a variety of constructions, shapes, sizes, quantities, and positions but still accomplish the same intent. The drip shield 112 depicted in the accompanying figures may include additional components and that some of the components described in those figures may be removed and/or modified without departing from scopes of the elements disclosed herein. The elements depicted in the figures may not be drawn to scale and thus, the elements may have different sizes and/or configurations other than as shown in the figures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A dishwashing appliance comprising:

a cabinet defining a singular cavity therein;

a spray system having one or more spray arms within said cavity;

one or more drawers mounted within said cavity, wherein each of said one or more drawers has an open bottom and is moveable between a closed position and an open position; and one or more drip shields below said open bottom of said one or more drawers, wherein each of said one or more drip shield is moveable between a first position and a second position through a retractable movement, a telescoping movement, and/or a louvered movement.

2. The dishwashing appliance of claim 1, wherein each of said one or more drawers further comprises a drawer front with a sealing surface contacting said cabinet.

3. The dishwashing appliance of claim 2, wherein said closed position of each of said one or more drawers corresponds to said one or more drawers respectively being entirely within said cavity and said sealing surface contacting said cabinet.

4. The dishwashing appliance of claim 3, wherein said open position of each of said one or more drawers corresponds to a position different from said closed position wherein a portion of said one or more drawers is outside of said cavity.

5. The dishwashing appliance of claim 4, wherein said first position of each of said one or more drip shields is configured to allow washing fluid from said spray system to spray through said open bottom of each of said one or more drawers when each of said one or more drawers is in said closed position.

6. The dishwashing appliance of claim 5, wherein said second position of each of said one or more drip shields is configured to collect drips of washing fluid dripping through said open bottom of each of said one or more drawers when each of said one or more drawers is in said open position.

7. The dishwashing appliance of claim 6, wherein at least one of said one or more drip shields is a retractable film retractable in a roller.

8. The dishwashing appliance of claim 7, wherein said roller is secured to said cabinet and a free end of said retractable film is secured to at least one of said one or more drawers to allow said retractable film to extend from said first position to said second position simultaneously with said at least one drawer sliding from said closed position to said open position, and to retract from said second position to said first position simultaneously with said at least one drawer sliding from said open position to said closed position.

9. The dishwashing appliance of claim 8, wherein said free end of said retractable film is secured to a top portion of said drawer front of said at least one drawer to allow said retractable film to extend from said first position to said second position simultaneously with said at least one drawer sliding from said closed position to said open position, and to retract from said second position to said first position simultaneously with said at least one drawer sliding from said open position to said closed position.

10. The dishwashing appliance of claim 7, wherein said roller is secured to at least one of said one or more drawers and a free end of said retractable film is secured to said cabinet to allow said retractable film to extend from said first position to said second position simultaneously with said at least one drawer sliding from said closed position to said open position, and to retract from said second position to said first position simultaneously with said at least one drawer sliding from said open position to said closed position.

11. The dishwashing appliance of claim 6, wherein at least one of said one or more drip shields is a telescoping shield, wherein a first end of said telescoping shield is secured to said cabinet and a second end of said telescoping shield is secured to at least one of said one or more drawers to allow said telescoping shield to extend from said first position to said second position simultaneously with said at least one drawer sliding from said closed position to said open position, and to retract from said second position to said first position simultaneously with said at least one drawer sliding from said open position to said closed position.

12. The dishwashing appliance of claim 6, further comprising one or more links between said one or more drawers in a staked manner to allow said stacked drawers to move simultaneously.

13. The dishwashing appliance of claim 6, wherein at least one of said one or more drip shields is in a louver configuration, wherein said louver is open in said first position and is closed in said second position.

14. The dishwashing appliance of claim 2, wherein said drawer front is a hinged drawer front, wherein at least one of said one or more drip shields stows within said hinged drawer front in said first position and extends out from said hinged drawer front in said second position.

15. The dishwashing appliance of claim 1, wherein at least one of said one or more drip shields is in a retractable toe panel configuration, wherein said retractable toe panel stows within said cabinet in said first position and extends out from said cabinet in said second position.

16. The dishwashing appliance of claim 1, wherein at least one of said one or more drip shields comprises one or more moving partitions, wherein said one or more moving partitions are configured to form a gap in said first position and to shift to close said gap in said second position.

17. The dishwashing appliance of claim 1, further comprising a splash shield on one or more sides of at least one of said one or more drawers.

18. The dishwashing appliance of claim 17, wherein said splash shield is retractable within said cavity.

19. The dishwashing appliance of claim 1, wherein at least one of said one or more drip shields is made of water repellent and/or semi-permeable material.

20. The dishwashing appliance of claim 1, further comprising a rack within in at least one of said one or more drawers.

21. A dishwashing appliance comprising:

a cabinet defining a singular cavity therein;

one or more drawers mounted within said cavity, wherein each of said one or more drawers has an open bottom and is moveable between a closed position and an open position; and one or more drip shields below said open bottom of said one or more drawers, wherein each of said one or more drip shields is switchable between a first position and a second position through a retractable movement, a telescoping movement, and/or a louvered movement.

22. The dishwashing appliance of claim 21, wherein each of said one or more drip shields is switchable between the first position and the second position through the louvered movement.

23. The dishwashing appliance of claim 21, wherein each of said one or more drip shields is switchable between the first position and the second position through the telescoping movement.

24. The dishwashing appliance of claim 21, wherein each of said one or more drip shields is switchable between the first position and the second position through the retractable movement.

25. The dishwashing appliance of claim 21, wherein said second position of each of said one or more drip shields is configured to fully cover said open bottom of each of said one or more drawers.

26. The dishwashing appliance of claim 25, wherein each of said one or more drip shields switches from said first position to said second position simultaneously with each of said one or more drawers sliding from said closed position to said open position.

* * * * *